United States Patent [19]

Gherardi

[11] Patent Number: 4,716,910

[45] Date of Patent: Jan. 5, 1988

[54] FLUTED DRUM DEVICE FOR WITHDRAWING ROD-LIKE ARTICLES FROM A FEEDING HOPPER

[75] Inventor: Gian L. Gherardi, Medicina, Italy

[73] Assignee: Sasib S.p.A., Bologna, Italy

[21] Appl. No.: 886,103

[22] Filed: Jul. 16, 1986

[30] Foreign Application Priority Data

Jul. 24, 1985 [IT] Italy ..... 12546 A/85

[51] Int. Cl.[4] ..... A24C 5/52

[52] U.S. Cl. ..... 131/94; 131/282

[58] Field of Search ..... 198/550.13, 550.5; 131/280, 281, 94, 282

[56] References Cited

U.S. PATENT DOCUMENTS 3,715,056 2/1973 Preston ..... 131/94
4,270,670 1/1981 Cristiani ..... 198/550.5

FOREIGN PATENT DOCUMENTS

84/03819 10/1984 World Int. Prop. O. ..... 131/94
0210316 1/1967 Sweden ..... 131/94

*Primary Examiner*—V. Millin
*Assistant Examiner*—H. Macey
*Attorney, Agent, or Firm*—Spencer & Frank

[57] ABSTRACT

The object of the invention is a device for withdrawing rod-like articles (B) from a feeding hopper (1). More particularly, the invention provides a device for withdrawing filter plugs for the manufacture of filter-tipped cigarettes.

A portion of the hopper bottom is formed by a fluted drum (2) for receiving one rod-like article (B) into each one of its flutes (3) at the time of its passing by the feeding hopper (1). A portion of the hopper bottom, which is adjacent to the fluted drum (2), is formed by at least one endless conveyor belt (7) having a width which is sensibly smaller than the length of the rod-like articles (B) and the length of the fluted drum (2). The upper branch of the conveyor belt (7) entrains articles to the drum flutes and gets into and through a respective peripheral annular groove (6) in the fluted drum (2), at least as far as to substantially reach the path of the bottoms of the drum flutes (3) situated at both sides of the groove. The conveyor belt (7) preferably is a suction belt, and is led around the fluted drum (2) on the bottom of the peripheral annular groove (6) in the drum.

12 Claims, 5 Drawing Figures

FLUTED DRUM DEVICE FOR WITHDRAWING ROD-LIKE ARTICLES FROM A FEEDING HOPPER

SUMMARY OF THE INVENTION

The invention refers to the devices for withdrawing rod-like articles, particularly filter plugs for the manufacture of filter-tipped cigarettes, from a feeding hopper and by means of a rotary fluted drum forming a portion of the hopper bottom, and only one rod-like article having to be accomodated in each flute in said drum, at the time of its passing by the hopper.

In the known devices of this kind, when the speed of rotation of the fluted drum is increased in order to increase the speed at which the rod-like articles are fed to the successive processing machine, the filling of the flutes in the drum becomes irregular, i.e., some flutes are left empty, and these empty flutes will in turn cause irregularities and problems to arise in the successive processing machine. To obviate to these drawbacks, it is known to render the fluted drum a suction drum, that is to say, to cause air to be sucked through small perforations provided in the flute bottoms, at least during the passing of the flutes by the hopper, so as to compel the insertion of the rod-like articles into the single flutes and to hold them by suction therewithin. To guarantee the filling of the flutes, it is also known to provide an endless conveyor belt that forms a portion of the hopper bottom which is adjacent to the ascending part of the fluted drum, and which is downwardly inclined toward the said drum (GB-A No. 1538582). This conveyor belt is imparted a movement which is concordant with the movement of the fluted drum, and it should keep in rolling motion the overlying mass of rod-like articles, whereby the forming of bridges is avoided. Notwithstanding the above-mentioned known provisions, when the speed of rotation of the fluted drum is increased, some flutes are always left empty.

To eliminate the aforementioned drawbacks in the known constructions is the object of the invention, which aims to guarantee a regular filling of the fluted drum flutes with the rod-like articles contained in the feeding hopper of a device as disclosed at the beginning, in a simple manner and even at a sensibly higher rotational speed of the drum than the up to now attainable speeds.

For the solution of this problem, the invention provides a device for withdrawing rod-like articles, particularly filter plugs for the manufacture of filter-tipped cigarettes, from a feeding hopper and by means of a rotary fluted drum forming a portion of the hopper bottom, while a portion of the hopper bottom which is adjacent to the fluted drum, is formed by at least one endless conveyor belt, the upper branch of which runs toward the fluted drum. According to the invention, this device is characterized in that the conveyor belt has a width which is sensibly smaller than the length of the rod-like articles, and the length of the fluted drum, and its upper branch gets into and through a respective peripheral annular groove in the said fluted rum, at least as far as to substantially reach the path of the bottoms of the drum flutes situated at both sides of the said groove.

In the device according to the invention, the rod-like articles resting in a continuous layer on the upper branch of the conveyor belt, are entrained thereby toward the fluted drum. While the upper branch of the conveyor belt is getting into the peripheral annular groove in the fluted drum, the drum ribs which at both sides of the peripheral annular groove in said drum delimit the drum flutes, are gradually raising up from the plane of the conveyor belt, and gradually interpose themselves between the rod-like articles resting on the said belt. Thus, the rod-like articles resting in a continuous layer on the upper branch of the conveyor belt and being entrained thereby toward the flutted drum, are taken the one after the other from the drum and are each continuously accomodated in one flute in the drum, so that the filling of all the drum flutes is guaranteed even at the high rotational speeds of said drum.

Preferably, instead of only one conveyor belt, two or more parallel and spaced apart conveyor bands are associated with the fluted drum, and each one of them gets into and through one respective peripheral annular groove in the drum, and these bands form together the portion of the hopper bottom which is adjacent to the fluted drum.

Additionally, according to a further feature of the invention, in order to guarantee the forming of a continuous layer of rod-like articles on the conveyor belt or the conveyor bands, and the entraining of the said layer of rod-like articles toward the fluted drum, the said belt or the said bands is or are preferably made as a suction belt or as suction bands.

The upper branch of the conveyor belt or the conveyor bands may be disposed as desired, either substantially horizontal, or inclined upwardly from below or downwardly from above, toward the fluted drum. Preferably, and particularly when the conveyor belt or the conveyor bands is or are made as a suction belt or as suction bands, the upper branch thereof is inclined upwardly from below, toward the fluted drum. Thus, upstream of the fluted drum a deeper area is formed in the feeding hopper, which is adapted for containing a sufficient reserve of rod-like articles.

In order to ensure that the rod-like articles being entrained toward the fluted drum by the conveyor belts or the conveyor bands, will be smoothly engaged by the ribs delimiting the drum flutes, and will be delicately accomodated in said flutes, the upper branch of the conveyor belt or the conveyor bands is preferably caused to slide at a speed that is substantially the same as the peripheral speed of the flutes in the fluted drum.

The conveyor belt or the conveyor bands may be supported and driven in any suitable manner. Thus, for example, the upper branch of the conveyor belt or of each one of the conveyor bands may be led around a guide roller mounted onto the end of a supporting arm extending into the respective peripheral annular groove in the fluted drum. However, in one preferred embodiment of the invention the conveyor belt or each one of the conveyor bands is or are led around the fluted drum on a cylindrical guide surface provided at the bottom of the respective peripheral annular groove in the fluted drum.

These and other features of the invention and the advantages arising therefrom will appear more in detail in the following specification of some embodiments thereof, shown by way of non-limiting examples in the accompanying drawings, in which:

DESCRIPTION OF THE PREFERRED EMBODIMENT

Figure 1:
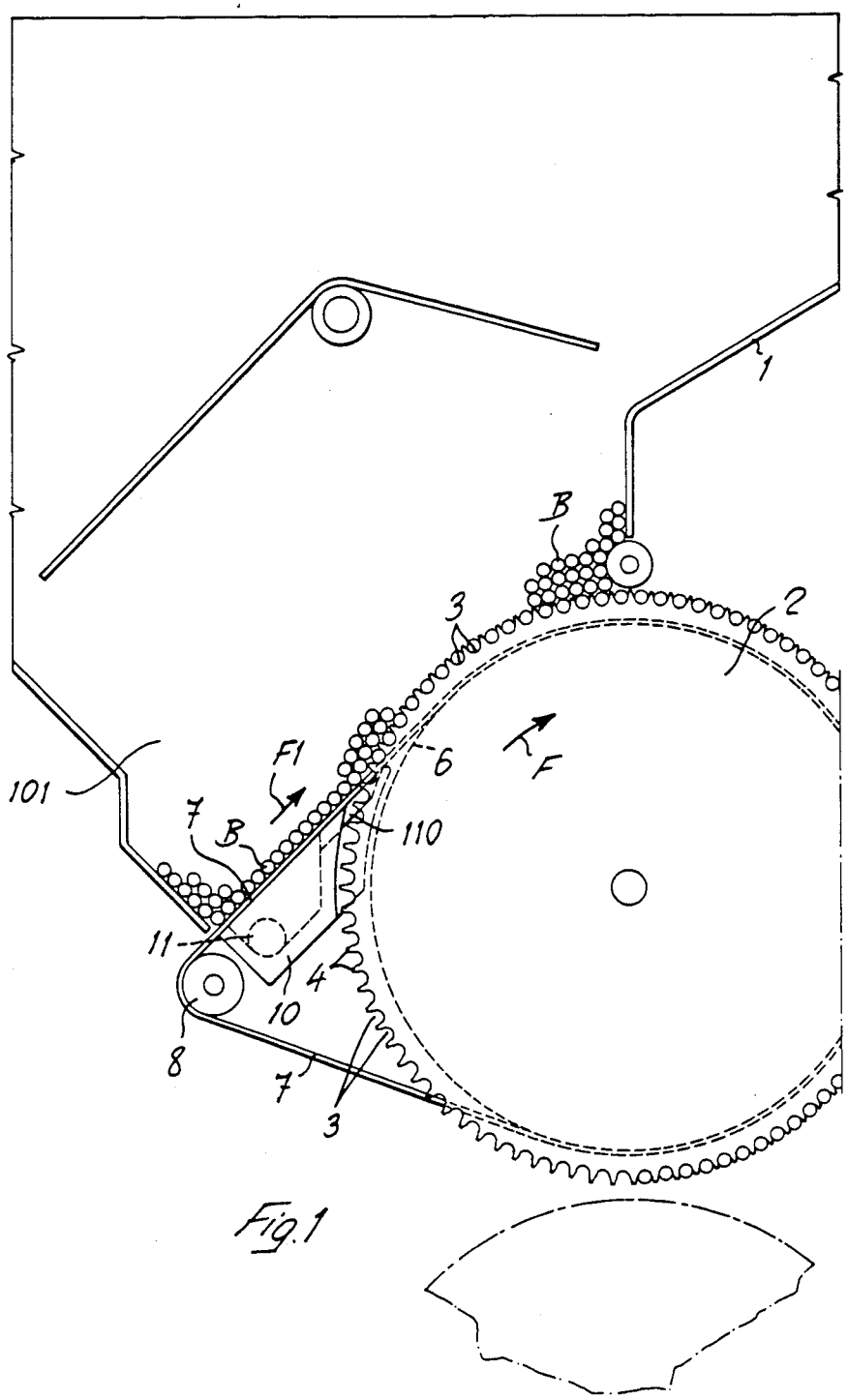
FIG. 1 is a partly elevational view diagrammatically showing a rod-like article-feeding hopper with a withdrawing device according to the invention.
Figure 2:
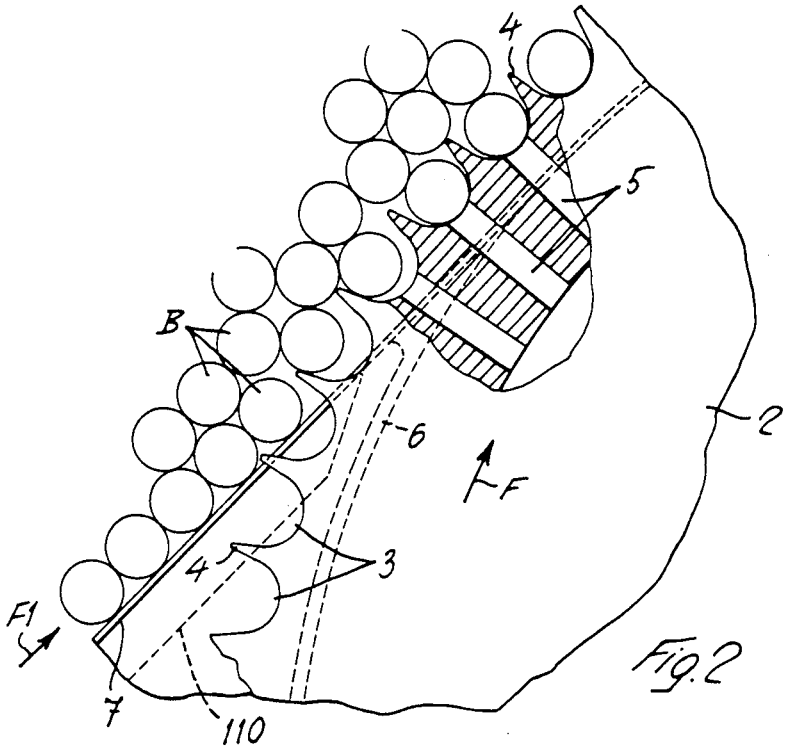
FIG. 2 is a partly sectional view in an enlarged scale, showing a detail of FIG. 1.

Referring to the figures, numeral 1 denotes a hopper for feeding any rod-like articles to a successive processing machine, particularly a hopper for feeding filter plugs B to a machine for the manufacture of filter-tipper cigarettes. A portion of the bottom of the feeding hopper 1 is formed by a fluted drum 2 rotating in the direction of arrow F. The drum 2 is peripherally provided in known manner with flutes 3 which are adapted for containing each one filter plug B, and which are mutually delimited by ribs 4 having a spire-like profile. Each flute 3 in drum 2 has its bottom provided with bores 5, through which a suction can be generated in flute 3 for attracting and holding a filter plug B.

The fluted drum 2 has a plurality of peripheral annular grooves 6, and in each one of them there is received an endless conveyor band 7 led around the fluted drum 2 and around a guide roller 8, and which kept stretched by conventional belt-stretching means (not shown). These conveyor bands 7 are so made as to be air-permeable, and their upper branches form a portion of the feeding hopper 1 bottom which is adjacent to the fluted drum 2, and run over slots 9 or rows of bores provided in the top of a fixed suction box 10 that is arranged between the fluted drum 2 and the guide roller. The suction box 10 is evactuated through the union 11, and has hollow extensions 110 stretching out under the bands 7 toward the drum 2, and partly getting into the peripheral annular grooves 6 in the fluted drum 2. The slots 9 or rows of bores in the suction box 10 extend also along the said extensions 110 of box 10. By means of the suction box 10 and the slots 9 or rows of bores thereof, the upper branches of the conveyor bands 7 are caused to become suction branches, so that they exert a certain holding action on the filter plugs B resting thereon.

The peripheral annular grooves 6 in the fluted drum 2 are of such a depth that the surface of the conveyor bands 7 upper branches arriving at, and getting into the drum 2, intercepts the cylindrical path of the bottoms of flutes 3 in drum 2, and when the said bands 7 come down on the bottom of the respective peripheral annular groove 6 in the fluted drum 2, this surface comes to be situated slightly below the bottoms of said flutes 3. In other words, the peripheral annular grroves 6 in the fluted drum 2 are deeper than the flutes 3.

More particularly, when the conveyor bands 7 are made as suction bands, as above disclosed, the guide roller 8 for the conveyor bands 7 is preferably located at a level below the summit of the fluted drum 2, so that the upper branches of the conveyor bands 7 will have a rising direction toward the drum 2, and upstream of this drum a lower area 101 is formed in the feeding hopper 1, which contains a sufficient reserve of filter plugs B.

Figure 4:
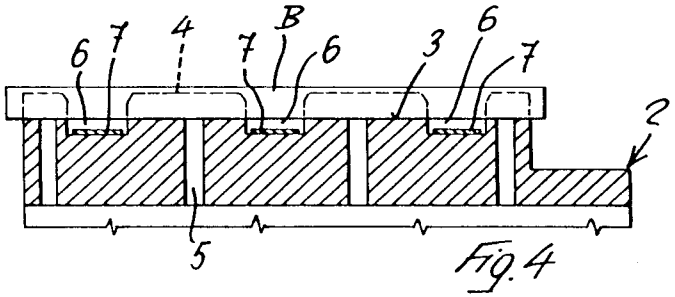
FIG. 4 is a radial sectional view taken on line IV—IV of FIG. 3, and showing a first modified embodiment of the device according to the invention.

In the embodiment shown in FIGS. 1 to 4, the conveyor bands 7 bear directly on the bottoms of the peripheral annular grooves 6 in the fluted drum 2, and are entrained in motion by the same drum 2, which therefore acts as a driving guide pulley, as it appears particularly in in FIG. 4. In this instance, the speed at which the conveyor bands 7 slide is slightly lower than the peripheral speed of the fluted drum 2, however this difference is very small, and does not adversely affect the proper operation of the device, as it will be described hereinafter.

Figure 5:
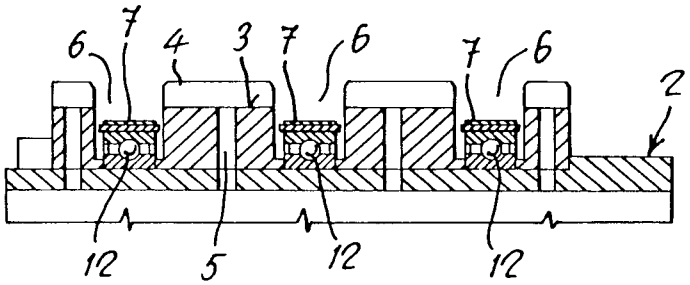
FIG. 5 is a radial sectional view similar to that of FIG. 4, and showing a second modified embodiment of the device according to the invention.
Figure 3:
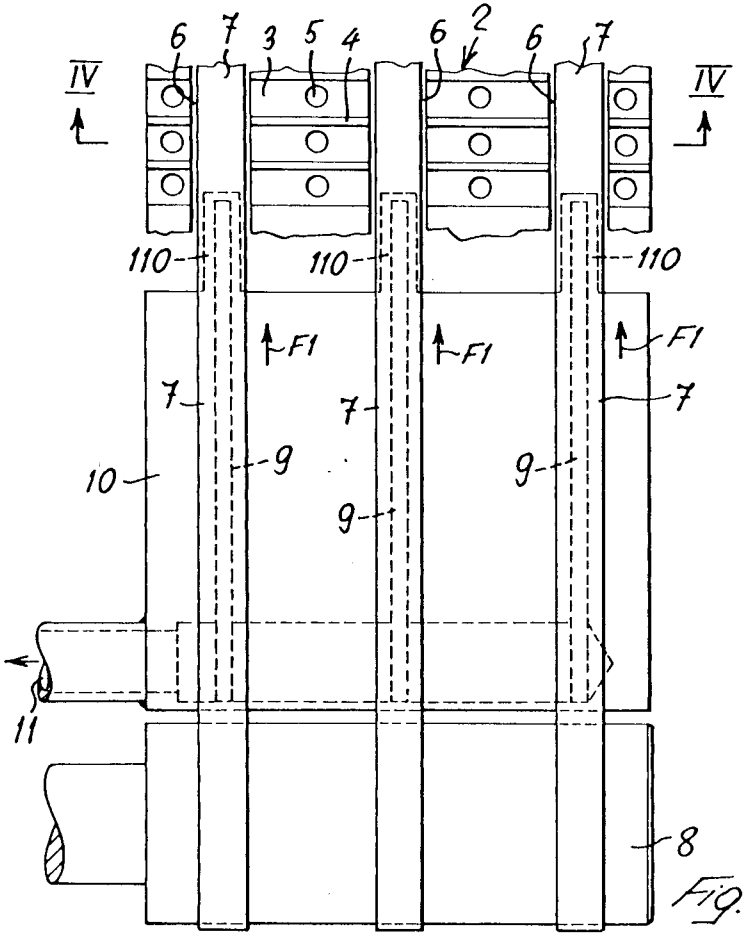
FIG. 3 is a top view showing the withdrawing device according to the invention in an enlarged scale as compared to that of FIG. 1.

In one alternative embodiment shown in FIG. 5, the bottom of the peripheral annular groove 6 in the fluted drum 2 is formed by a rolling bearing 12, and the conveyor bands bear on the external freely rotatable races of these bearings 12, and are driven by the suitably powered guide roller 8. In this instance, the speed at which the conveyor bands can be selected at will and can be changed independently of the rotation of the fluted drum 2, so that it can even be just the same as the peripheral speed of drum 2.

In both of the above embodiments, in the region 101 of the feeding hopper 1 a continuous layer of filter plugs B is formed on the suction conveyor bands 7, and this layer is entrained by the conveyor bands 7 towards the fluted drum 2. In correspondence of the area at which the conveyor bands 7 meet the fluted drum 2 and get into the respective peripheral annular groove 6 in drum 2, these conveyor bands come across the path of flutes 3 in drum 2, and are moved to a diameter which is smaller than the diameter at which lie the bottoms of flutes 3. Consequently, the spire-like profiled ribs 4 delimiting the flutes 3 gradually raise up over the plane of the conveyor bands 7 and smoothly work their way between the filter plugs B carried by the bands 7, thus lifting up these filter plugs from the bands 7 and installing each one of them within a flute 3 in drum 2, as it is particularly evident in FIG. 2. The taking of the filter plugs B from between the ribs 4 of the fluted drum 2 and their transfer into the flutes 3 in said drum occurs smoothly and regularly without any flute being left empty, not even at the high rotational speeds of drum 2, notwithstanding the small differences between the pace of flutes 3 and the pace of the filter plugs B forming the continuous layer of plugs B on the conveyor bands 7, and notwithstanding the small difference in speed between the ribs 4 and the conveyor bands 7, in the embodiment according to FIGS. 1 to 4.

Of course, the invention is not limited to the just described and shown embodiments, but the same may be widely changed and modified, the more so in construction. Thus, for example, the conveyor bands 7 not always need to be suction bands, but they may simply have a corrugated or undulated surface, or anyhow a surface with a high coefficient of friction, for entraining the rod-like articles. In this instance, the upper branches of the conveyor bands 7 which form the bottom of the feeding hopper 1, may be preferably arranged substantially horizontally, or they may be even inclined downwardly toward the fluted drum 2. In all the various embodiments, the group of two or more conveyor bands 7 may be replaced with only one sufficiently wide conveyor belt. The whole without departing from the leading principle as set forth above and as claimed hereinafter.

I claim:

1. A device for withdrawing rod-like articles (B), particularly filter plugs for the manufacture of filter-tipped cigarettes, from a feeding hopper (1) with a fluted rotary drum (2) forming a portion of its bottom and being designed for receiving one rod-like article (B) into each one of its flutes (3) at the time of its passing by the feeding hopper (1), while a portion of the hopper bottom which is adjacent to the fluted drum (2), is formed by at least one endless conveyor belt (7) with its upper branch running toward the said fluted drum (2) for entraining articles to the flutes, characterized in that the conveyor belt (7) has a width which is sensibly smaller than the length of the rod-like articles (B) and the length of the fluted drum (2), and the upper branch of the said conveyor belt (7) gets into and through a respective peripheral annular groove (6) in the said fluted drum (2), the groove having a depth which is at least equal to the depth of the bottoms of the drum flutes (3).

2. The device according to claim 1, characterized in that two or more spaced apart parallel conveyor bands (7) are associated with the fluted drum (2), and the said bands (7) get each into one peripheral annular groove (6) in the drum (2), and together form the portion of the hopper bottom which is adjacent to the said fluted drum (2).

3. The device according to claim 1 characterized in that the conveyor belt or the conveyor bands (7) is or are made as a suction belt or as suction bands.

4. The device according to claim 3, characterized in that the upper branch of the conveyor belt, or of the conveyor bands (7) made from an air-permeable material, runs on a suction box (10), in correspondence of a slot or a row of bores provided in this box.

5. The device according to claim 4, characterized in that in the instance of a plurality of conveyor bands, the suction box has underneath each band an extension which is provided with a slot (9) or with a row of bores, and is fitted in the respective peripheral annular groove (6) in the fluted drum (2).

6. The device according to claim 1, characterized in that the upper branch of the conveyor belt or of the conveyor bands (7) is upwardly inclined from below, toward the fluted drum (2).

7. The device according to claim 1, characterized in that the conveyor belt or the conveyor bands (7) is or are caused to slide substantially at the same speed as the peripheral speed of the flutes (3) in the fluted drum (2).

8. The device according to claim 1, characterized in that the conveyor belt is led, or the conveyor bands (7) are each led around the fluted drum (2) on a cylindrical guide surface provided at the bottom of the respective peripheral annular groove (6) in the said fluted drum (2).

9. The device according to claim 8, characterized in that the cylindrical guide surface provided at the bottom of each peripheral annular groove (6) in the fluted drum (2) is integral with the said drum (2) and rotates therewith, thus entraining the respective conveyor belt or conveyor bands (7).

10. The device according to claim 8, characterized in that the cylindrical guide surface provided at the bottom of each peripheral annular groove (6) in the fluted drum (2) is mounted, relatively to the drum, for a free rotation around the axis of said drum (2), and the conveyor belt or the conveyor bands (7) is or are driven by another guide roller (8).

11. The device according to claim 1, characterized in that the upper branch of the conveyor belt or of each one of the conveyor bands (7) is led around a guide roller (8) which is mounted onto the end of a supporting arm extending into the respective peripheral annular groove in the fluted drum.

12. The device according to claim 1, characterized in that the flutes (3) of the fluted drum (2) are mutually delimited by ribs (4) having a spire-like profile.

* * * * *